United States Patent [19]

Leveille et al.

[11] Patent Number: 4,694,284

[45] Date of Patent: Sep. 15, 1987

[54] ABDUCTION-PREVENTING COLLAR

[76] Inventors: Serge Leveille; Jacqueline Cormier, both of 5001-H rue des Bocages, St-Augustin, Canada, G3A 1G4; Ginette Cormier; Pierre Brassard, both of 723 Mohawk Rd. East, Hamilton, Canada, L8T 2P9

[21] Appl. No.: 851,830

[22] Filed: Apr. 14, 1986

[51] Int. Cl.[4] ..... G08B 21/00

[52] U.S. Cl. ..... 340/574; 340/539; 340/573; 340/693

[58] Field of Search ..... 340/574, 573, 693, 539; 455/100

[56] References Cited

U.S. PATENT DOCUMENTS

| | | | |
|---|---|---|---|
| 3,478,344 | 11/1969 | Schwitzgebel et al. | 340/539 |
| 4,121,160 | 10/1978 | Cataldo | 340/573 |
| 4,157,540 | 6/1979 | Oros | 340/574 |
| 4,158,197 | 6/1979 | Takagaki | 340/574 |
| 4,430,757 | 2/1984 | Szakvary | 455/100 |
| 4,535,324 | 8/1985 | Levental | 340/574 |
| 4,591,836 | 5/1986 | Feigenblatt, Jr. et al. | 340/574 |
| 4,593,273 | 6/1986 | Marcisse | 340/539 |

*Primary Examiner*—Glen R. Swann, III

[57] ABSTRACT

The collar consists of two legs pivoted to each other at one end by a hinge member and releasably locked to each other at the other end by a key operated lock. The legs are made of shear-resistant material. A radio signal generating and transmitting device and autonomous power supply are housed within the collar. A trigger switch is closed to activate the device upon opening of a flap by the abducted collar wearer, and circuitry including a silicon controlled rectifier, causes activation of the transmitter and characterized by the impossibility of deactivation thereof, short of complete discharge of the power supply, as long as the lock locks the legs of the collar around the wrist, neck or ankle of the wearer.

8 Claims, 5 Drawing Figures

ABDUCTION-PREVENTING COLLAR

FIELD OF THE INVENTION

This invention relates to emergency signalling devices adapted to prevent abduction.

BACKGROUND OF THE INVENTION

It is well known to use radio-signalling devices in the case of isolated persons, when for example they find themselves in difficulty during trekking, cross-country skiing, or mountain climbing. However, in the case of a person becoming abducted for ransom or other purpose, such devices have been inefficient since the abductor could readily remove same, and therefore the signalling device would no more indicate the position of the victim. The occurrence of abduction increases nowadays, and such a situation should not be tolerated.

OBJECTS OF THE INVENTION

The prime object of the invention is therefore to provide an emergency apparatus worn by a person, which comprises a device which may be triggered to send a radio signal, yet cannot be deactivated thereafter and removed from the person except with the use of a key that is not carried by the person wearing the signalling apparatus.

Another object of the invention is to provide said device in the form of a reinforced collar, that can be locked around the wrist, neck or ankle of a person.

SUMMARY OF THE INVENTION

There is disclosed the combination of a collar adapted to surround a human body section such as a wrist, an ankle, or the neck and a radio signal generating and transmitting device housed within the collar. More precisely, the collar consists of two legs pivoted to each other at one end by a hinge member and releasably locked to each other at the other end by a key operated lock. The legs are made of shear-resistant material. The collar also houses an autonomous power supply, switch means to activate the device and circuitry to prevent deactivation of the device short of complete discharge of said power supply as long as said lock member locks said legs around said body section.

Preferably, the collar carries a timepiece for additional usefulness. The switch is preferably a normally open reed-switch kept in that state by the opposing magnetic fields of two permanent magnets. A first pemanent magnet is embedded within a flap outwardly pivoting from the outer wall of said collar. A second permanent magnet is secured spacedly inwards from the said reed-switch. The first and second magnets induce opposing magnetic fields which cancel when the said flap is closed. Opening the flap causes said reed-switch to close under the magnetic field of said second, inwardly secured, permanent magnet. The circuitry preferably includes a silicon controlled rectifier (S.C.R.) arranged to maintain operation of the signalling device even if the reed-switch is made to open. The said flap preferably includes a fingernail-engageable notch on its outer face, to facilitate handling thereof.

Preferably, there is provided a resetting switch in registry with said hinge member, which opens the circuit upon opening of the collar and resets said circuit.

DETAILED DESCRIPTION OF THE PREFERRED EMBODIMENT OF THE INVENTION

Figure 1:
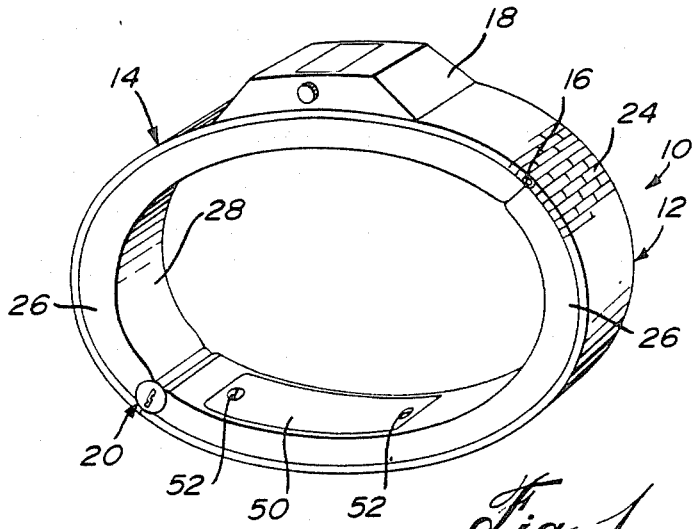
FIG. 1 is a downwardly-looking perspective view of a collar comprising a radio signal-generating and transmitting device according to a preferred embodiment of the invention.
Figure 2:
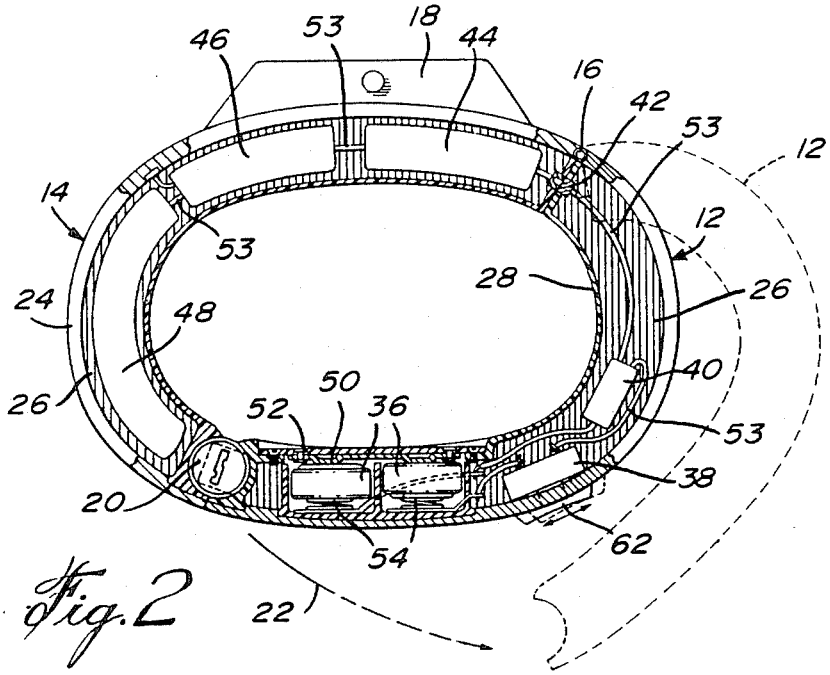
FIG. 2 is a sectional view of the collar, and further showing the latter in its opened position in phantom lines.

The radio signal transmitting collar, broadly denoted 10, is especialy adapted to fit the wrist of a child. However, it must be understood that the collar 10 need not necessarily be attached to the arm of a person, but it is envisioned to provide such a device in a band-like casing to fit the neck or an ankle of such person.

Collar 10 comprises a first leg 12 and a second leg 14 hinged together by a hinge 16. Leg 14 may carry a small timepiece 18 on its outer face, such as a digital watch. Legs 12, 14 can be interlocked at their outer ends by a lock member 20, carried by second leg 14, and key operated. Leg 12 can be opened along arrow 22 by outward pivoting about hinge member 16.

Each leg 12, 14 of collar 10 is preferably made of an outer metallic wall 24 surrounding and secured to a longitudinally curved body portion 26 made of plastic and inwardly lined with soft body-contacting material 28. The electrical components of the device 10 are embedded in body portions 26 of the two legs.

The electrical components include direct current power supply dry cells 36, embodied within the free end portion of leg 12, a reed-switch assembly 38, an S.C.R. 40 and one terminal of a hinge switch 42, all embedded in leg 12. Leg 14 houses the other terminal of switch 42, a signal generator 44, a VHF-UHF frequency transmitter 46 and an antenna 48 to transmit radio signals. A door 50 allows access to cells 36 from the inside, and is screwed to wrist band leg 12 by screws 52. Wiring 53 interconnects the circuit components and forms the terminals of the hinge switch 42.

More specifically, each cell 36 is biased against door 50 by a spring 54 and is shown as parallel connected. Cells 36 could be series connected if required.

Figure 3:
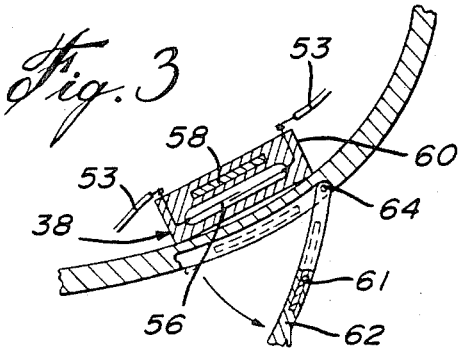
FIG. 3 is an enlarged sectional view of the portion of the collar showing the reed-switch.

Switch 38 is a conventional "reed-switch" type, comprising normally opened reed terminals 56 closable under the influence of a magnetic field (see FIG. 3). A first permanent magnet 58 is fixed to casing 60 of the switch, and a second permanent magnet 61 is embedded within a flap 62, hinged to the collar leg 12 at 64 and pivotable between a closed position, flush with the outside of leg 12, and an opened position. In the closed position, the two magnets 58, 61 are parallel and there is like polarity of the magnets in face to face relation. Therefore, the magnetic field is cancelled and there is no effect on the reed terminals 56, which remain in open position. Upon opening of flap 62, the magnetic field of magnet 58 closes reed terminals 56.

Figure 4:
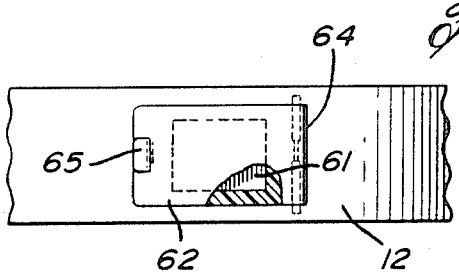
FIG. 4 is a bottom view of the collar showing the closure flap.

FIG. 4 shows that flap 62 has a notch 65 for nail insertion to open flap 62 against a snap which resiliently retains the same in closed position.

Figure 5:
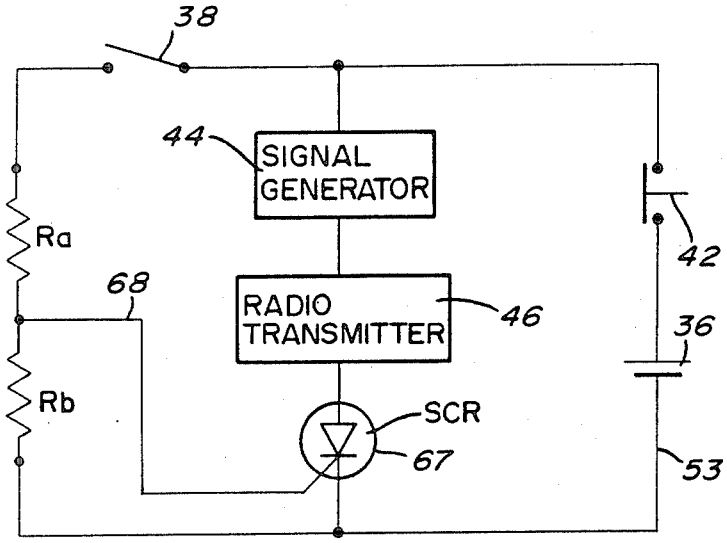
FIG. 5 is a wiring diagram.

FIG. 5 shows the wiring diagram: the S.C.R. 67, of the p-n-p-n- type, has a trigger circuit including reed-switch 38, wire 68, triggering resistance Ra and leakage resistance Rb, the values of which are chosen, as is well known, in accordance with the voltage and the type S.C.R. used. Once S.C.R. 67 is made conductive, it will remain so even if triggering reed-switch 38 is again opened by closing flap 62. Opening collar 10 opens hinge switch 42 and this resets the S.C.R. circuit 40.

Therefore, if the collar 10 is worn by a small child and the child opens the flap 62 upon being abducted, the child abductor will not be able to deactivate device 10 short of removing it. If the key for the lock 20 is not available to this abductor, he will not be able to remove the wrist band, except if the latter is cut by appropriate tools. This will take time and effort, especially if the material making the wristband is resistant to shearing tools.

Of course, the collar can be made in different sizes, to fit persons of variable weight. The VHF-UHF frequency used should be within the range that is allowed for security systems, preferably above 300 MHz.

The advantage of using VHF and/or UHF frequencies for the transmitter 34 is the wide range of readily available receivers: directional antenna receivers, amateur radio operators and television receivers.

This invention will allow persons who are victims of abduction, and especially children, to signal their presence in an effective manner, and should reduce the occurrence of such a crime. Furthermore, it is believed that with appropriate advertisement, the fact that a child wears such a collar should also have a deterrent effect for these child abductors. Police searches will be much more effective, since commercial radio operators may ask each individual of all the population within range which owns a radio receiver, to help in trying to locate a signal transmitted by the present device, through any of their home radio receivers.

What we claim is:

1. An abduction-preventing device comprising a collar adapted to surround a human body portion, said collar consisting of two legs pivoted one to the other at one end by a hinge member and releasably locked one to the other at the other end by a lock member, said legs being made of a shear-resistant material; a radio signal-transmitting circuit, an autonomous power supply for said circuit, and switching means to activate said circuit, all housed within said collar, and a switching means manual actuator accessible at the external face of said collar, said circuit further including means to prevent deactivation of said circuit once activated by said manual actuator, short of complete discharge of said power supply, while said lock member locks said legs around said body portion.

2. The device as defined in claim 1, wherein said lock member is actuatable by a removable key.

3. The device as defined in claim 1, wherein said switching means includes a reed-switch having normally opened reed terminals and a first permanent magnet adjacent said reed terminals, said actuator being a flap outwardly pivotable on said collar and a second permanent magnet carried by said flap and facing said first magnet in the closed position of said flap, with the reed terminals located between the two magnets and the faces of like polarity of said two magnets facing each other, the change in the state of the magnetic field produced by said magnets upon outward pivoting of said flap causing closing of said reed terminals

4. The device as defined in claim 3, wherein the portion of said collar in registry with said flap is of reduced thickness to define a recess of thickness equal to that of said flap to allow the latter therein.

5. The device as defined in claim 4, further including a fingernail-engageable notch at the outer edge of said flap.

6. The device as defined in claim 1, wherein said means to prevent deactivation includes a silicon controlled rectifier having a triggering circuit including said switching means.

7. The device as defined in claim 6, wherein said switching means includes a reed-switch having normally opened reed terminals and a first permanent magnet adjacent said reed terminals, said actuator being a flap outwardly pivotable on said collar and a second permanent magnet carried by said flap and facing said first magnet in the closed position of said flap, with the reed terminals located between the two magnets and the faces of like polarity of said two magnets facing each other, the change in the state of the magnetic field produced by said magnets upon outward pivoting of said flap causing closing of said reed terminals

8. The device as defined in claim 7, wherein said circuit further includes a hinge switch located at said hinge member closing upon closing of said legs and opening upon opening of said legs, said hinge switch resetting said circuit upon opening of said legs.

* * * * *